US011795720B2

(12) United States Patent
Watts

(10) Patent No.: US 11,795,720 B2
(45) Date of Patent: Oct. 24, 2023

(54) FOLDABLE MECHANIC'S CREEPER

(71) Applicant: Robert Dean Watts, Red Deer (CA)

(72) Inventor: Robert Dean Watts, Red Deer (CA)

( * ) Notice: Subject to any disclaimer, the term of this patent is extended or adjusted under 35 U.S.C. 154(b) by 0 days.

(21) Appl. No.: 17/400,143

(22) Filed: Aug. 12, 2021

(65) Prior Publication Data

US 2022/0049517 A1 Feb. 17, 2022

Related U.S. Application Data

(60) Provisional application No. 63/064,910, filed on Aug. 12, 2020.

(51) Int. Cl.
*B25H 5/00* (2006.01)
*E04H 6/42* (2006.01)

(52) U.S. Cl.
CPC ..... *E04H 6/428* (2013.01); *B25H 5/00* (2013.01)

(58) Field of Classification Search
None
See application file for complete search history.

(56) References Cited

U.S. PATENT DOCUMENTS 1,256,783 A 2/1918 Fuller
1,764,756 A 6/1930 Slee
D152,008 S 12/1948 Lucas
2,996,150 A 8/1961 Cassem
3,984,116 A 10/1976 Bowers
4,671,024 A 6/1987 Schumacher
4,909,524 A 3/1990 Paine
5,419,945 A 5/1995 Lopez
8,480,097 B1 7/2013 Judge et al.
9,303,816 B1 * 4/2016 Browning ..... F16N 31/006

FOREIGN PATENT DOCUMENTS

FR 3072951 * 12/2019

OTHER PUBLICATIONS

Machine translation of FR3072951 (Year: 2022).*

* cited by examiner

*Primary Examiner* — Alexander S Thomas
(74) *Attorney, Agent, or Firm* — Sander R. Gelsing

(57) ABSTRACT

In one aspect there is provided a foldable creeper having a body comprised of a foldable material. The body has a first end, a second end and is foldable in a direction along a folding axis. The creeper further comprises a bottom, a raisable circumferential wall having first end portion, a second end portion, a first side wall and a second side wall, said first and second side walls running along axes that are substantially parallel to the folding axis, and a plurality of rigid panel members. The plurality of rigid panel members are positioned at panel locations within or along each of the first and second side walls. The first end portion, the second end portion and the first and second side walls are moveable relative to the bottom and cooperate to form a circumferential raised barrier around the periphery when the creeper is in an unfolded configuration.

19 Claims, 13 Drawing Sheets

FOLDABLE MECHANIC'S CREEPER

CROSS REFERENCE TO RELATED APPLICATION

This application is a non-provisional application which claims priority to, and benefit of, U.S. Provisional Patent Application Ser. No. 63/064,910 filed Aug. 12, 2020 and entitled, "FOLDABLE MECHANIC'S CREEPER", the entirety of which is incorporated herein by reference.

FIELD OF THE INVENTION

This invention relates generally to ground mats, mechanic's creepers and mats for catching vehicle drippings. More particularly, the invention relates to foldable mechanic's creepers suitable to catch and contain liquid drippings from vehicles.

BACKGROUND OF THE INVENTION

The background information discussed below is presented to better illustrate the novelty and usefulness of the present invention. This background information is not admitted prior art.

Mechanics creepers for use by repair persons or mechanics are well known. They typically comprise a flat framework on rollers or casters, upon which a mechanic lies while working under an automobile or the like. However, such rollers or casters raise the framework (and the mechanic lying thereon) and such creepers are not ideal for use under vehicles having low ground clearance. Moreover, rollers and casters add to the overall complexity and cost of a mechanic's creeper.

Casterless creeper are also know, for example as disclosed in U.S. Pat. No. 1,764,756, by R. W. Slee, issued Jun. 17, 1930 for "Automobile Creeper." The creeper disclosed there comprises a flat body portion adapted to slide on the floor and ground, along with a head rest with rigid base extension for engagement by the head and body of a user to advance it on the floor or ground. That creeper was built rigid cellular board having longitudinal corrugations left open at their ends for draining any water or oil out of the creeper. However, allowing water and oil to drain out of a creeper is often undesirable, e.g. in the case of oil changes where any spilled oil can ruin a garage floor or create environmental damage. Moreover, the rigid flat body of the creeper taught by Slee makes storing it more challenging as compared to a creeper that can be collapsed or folded. These prior-art creepers are also not suitable for use in outdoor winter scenarios, such as when there is a significant amount of snow on the ground; their casters get jammed and ice logged in snow, while having open ends for draining will result in snow getting on the inside of the creeper and onto a user.

Therefore, what is needed is a creeper or ground mat that does not suffer from these aforedescribed limitations.

SUMMARY OF THE INVENTION

In an embodiment of the invention, there is provided a foldable creeper comprising a foldable body comprised of a foldable material. The foldable body has a first end, a second end and is foldable in a direction along a folding axis. The creeper further comprises a bottom, a raisable circumferential wall having first end portion, a second end portion, a first side wall and a second side wall, said first and second side walls running along axes that are substantially parallel to the folding axis, and a plurality of rigid panel members. The plurality of rigid panel members are positioned at panel locations within or along each of the first and second side walls. The first end portion, the second end portion and the first and second side walls are moveable relative to the bottom and cooperate to form a circumferential raised barrier around the periphery thereof when the creeper is in an unfolded configuration.

In a preferred embodiment of the invention the foldable material is capable of containing water, oil and other liquids that may drain or leak out of a motor vehicle and when in the unfolded configuration and used underneath the motor vehicle, the bottom and the circumferential raised barrier cooperate to create a liquid catching basin.

In a further preferred embodiment of the invention the plurality of rigid panel members maintain the foldable material of the circumferential wall in a raised and upright position when the creeper is in the unfolded configuration.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figure 1:
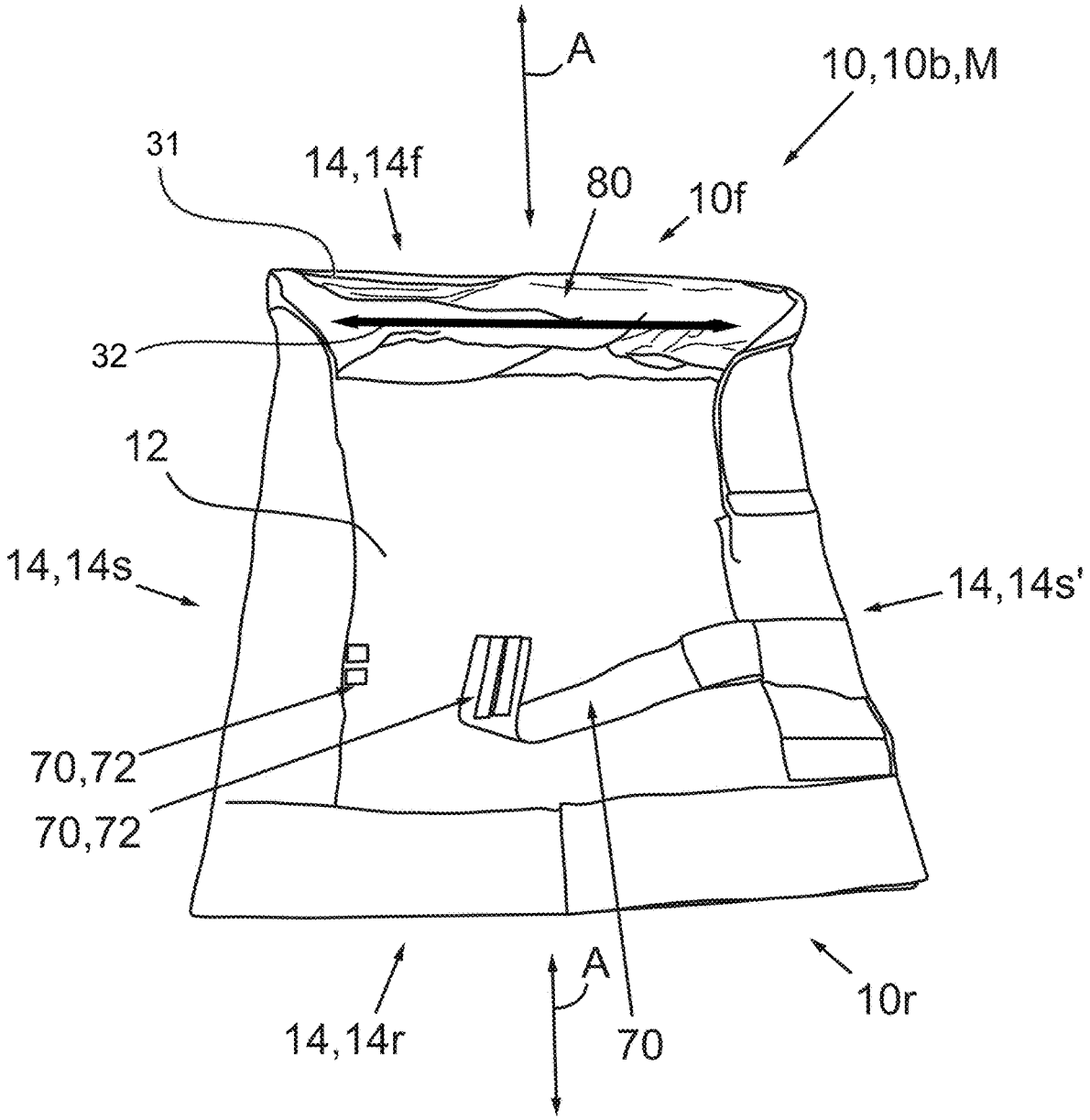
FIG. 1 is a perspective view of one embodiment of a foldable creeper, shown in a mostly unfolded configuration.

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

Referring generally to the figures, the foldable creeper 10 preferably comprises a foldable body 10*b* having a first or front end 10*f* and a second or rear end 10*r*. The body 10*b* is foldable in a direction along a folding axis A, which preferably runs substantially perpendicular to the axis of the front and rear ends 10*f*, 10*r*; i.e. so that the creeper 10 can be folded from rear to front (or vice versa); see FIGS. 4*a* to 4*c*. The creeper 10 can therefore be in a folded configuration (e.g. FIGS. 4*c* and 5*f*), an unfolded configuration (e.g. FIG. 2) and various partially folded configurations therein in-between.

Figure 2:
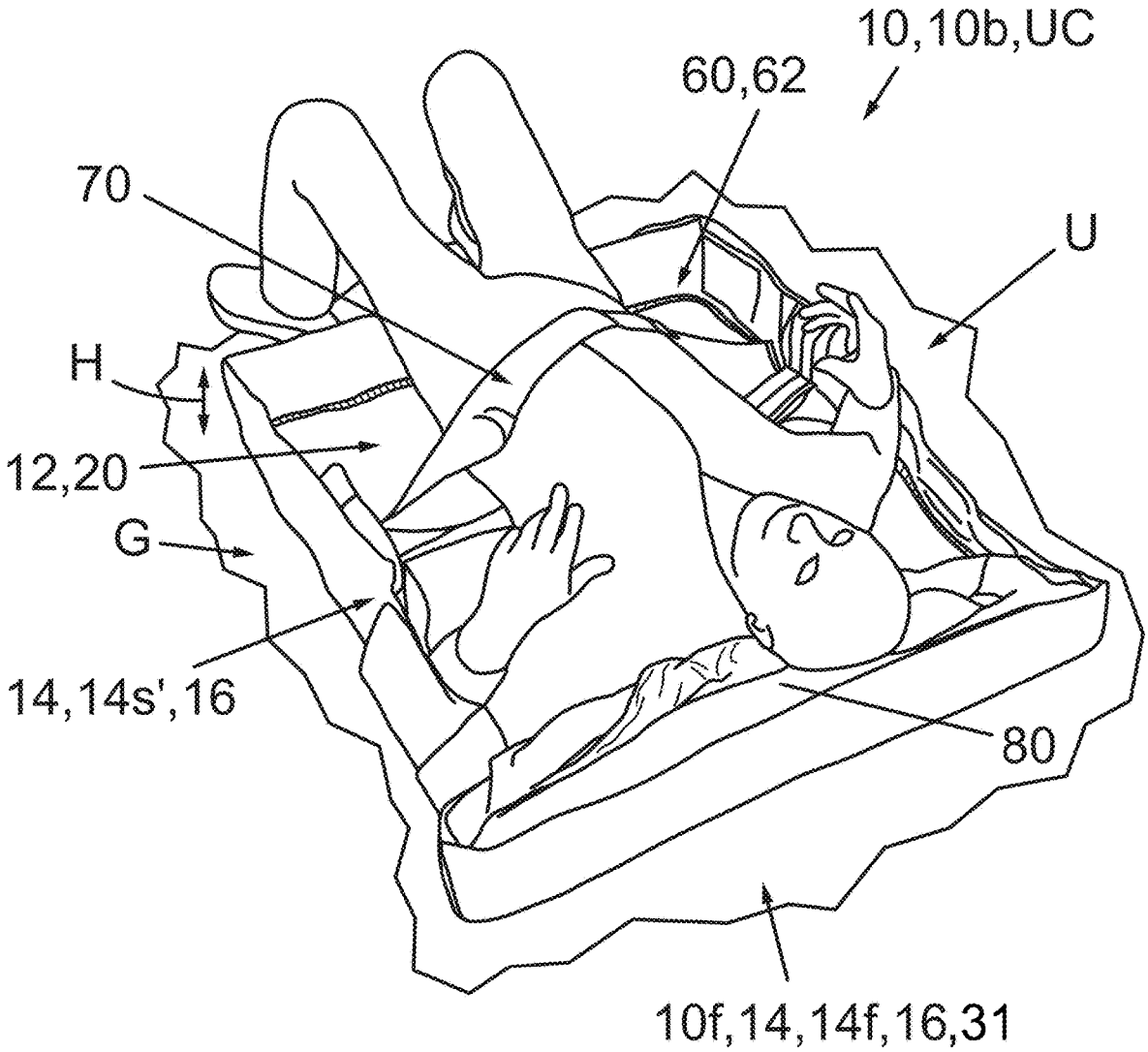
FIG. 2 is another perspective view of the foldable creeper of FIG. 1, shown in an unfolded configuration and in use by a user.

The terms "front" and "rear" are used herein as respective references to the orientation of the foldable creeper 10 when used by a user U, wherein the "front" end will be that end where the user U may place his or her head (see FIG. 2), and wherein the "rear" end will be that end where the user may place their legs (or drape their legs over such end; e.g. FIG. 2). However, there may be other uses and/or different orientations for the foldable creeper 10 when the terms "front" and "rear" may not apply and wherein the terms "first" and "second" ends are more appropriate.

The body 10*b* preferably comprises a bottom 12 and an upturnable or raiseable circumferential wall 14, i.e. where wall 14 may be folded against the bottom (as can be seen in FIG. 1) or upturned away from the bottom 12 (as can be seen in FIG. 2). The bottom 12 is preferably substantially planar when in the unfolded configuration. The bottom end of the circumferential wall 14 is preferably joined to (or integral with) the bottom 12, and it can form a substantially raised circumferential barrier 16 when in the unfolded configuration, i.e. when upturned, raised or "popped up" relative to the planar bottom 12; see FIG. 2.

Preferably the body 10*b* is constructed from a flexible and foldable material M which is water-proof and suitable to contain water, oil and other liquids that may drain or leak out of motor vehicles (such as antifreeze, brake fluid and power steering fluid). The embodiment of FIGS. 1 to 5*f* is constructed from a polyethylene material (similar to that used to make tarps). However, other materials, such as flexible rubber or water-proof cloth will also be suitable to construct the body 10*b*, so long as the body 10*b* remains foldable in a direction along the folding axis A.

The circumferential wall 14 further comprises a first or front-end portion 14*f* (at the front end 10*f*), a second or rear-end portion 14*r* (at the rear end 10*r*), a first side wall 14*s* and a second side wall 14*s*'. Preferably, the side walls 14*s*, 14*s*' run along an axis that is substantially parallel to the folding axis A, and substantially perpendicular to the front-end portion 14*f* and rear-end portion 14*r*. Additionally, when the creeper 10 is in the unfolded configuration, the front-end portion 14*f*, rear-end portion 14*r* and side walls 14*s*, 14*s*' are raised (upturned or pivoted) relative to the bottom 12 and cooperate to form the circumferential raised barrier 16 around the periphery of said bottom 12.

Advantageously, when in the unfolded configuration and used underneath a vehicle, the bottom 12 and the circumferential raised barrier 16, cooperate to provide a liquid catching basin 20 to catch any oil, water or other liquid that may come off of such vehicle and which might otherwise ruin a garage floor or create environmental damage. Preferably, the circumferential raised barrier 16 is at least 2 inches in height H above the bottom 12 (when raised). More preferably, the circumferential raised barrier 16 is 6 inches in height H above the bottom 12, so as to allow the creeper 10 to be used in snow covered ground scenarios and the like, and thereby preventing said snow from falling from the outside into the basin 20.

It is to be understood that if sufficient tension was provided to the circumferential wall 14, it could be maintained in a raised position (relative to the bottom 12) and maintain the substantially raised circumferential barrier 16. However, to further assist the circumferential wall 14 in forming and maintaining the substantially circumferential raised barrier 16 (when the creeper 10 is in the unfolded configuration), the creeper 10 preferably comprises a plurality of rigid panel members 30 positioned at panel locations L along or within the circumferential wall 14. The rigid members 30 may be comprised of cardboard, plastic, wood or other rigid material suitable to maintain the flexible and foldable material M in an upright and raised manner (relative to the bottom 12) when the creeper 10 is in the unfolded configuration. In a preferred embodiment, the panel members 30 are 6 inches in height and between 8 to 10 inches in length. Advantageously, the panel members 30 being rigid, maintain the flexible and foldable material M of the circumferential wall 14 in a raised and upright position, when the creeper 10 is in the unfolded configuration, thereby establishing the liquid catching basis 20 (see FIG. 2). Panel members 30 may also be of other suitable dimensions, such as 2 inches in height and between 4 to 8 inches in length.

In the embodiment of FIGS. 1-5*f*, the circumferential wall 14 is preferably manufactured by folded-over section (dual layer) of polyethylene material, and the rigid panel members 30 are placed therewithin at the various panel locations L during manufacturing. As such they are not visible when the creeper 10 is viewed by a user U. The panel members 30 are therefore schematically illustrated in the figures by means of white outlined rectangles labelled 30 (e.g. as in FIG. 5*a*). In other embodiments (not shown), the circumferential wall 14 may be provided with pockets or sleeves to receive the rigid panel members 30 at the panel locations L. In still other embodiments (not shown), the rigid panel members 30 may be attached to the circumferential wall 14 at the locations L (e.g. either to the inside or outside portions of said wall 14), such as by gluing, stapling, or via a removable attachment means such as a VELCRO™ brand hook and loop fastener.

Preferably, a single rigid panel member 31 is provided in, or on, each of the front-end and rear-end portions 14*f*, 14*r* of the circumferential wall 14, extending substantially along said front-end and rear-end portions 14*f*, 14*r* between the side walls 14*s*, 14*s*'. More preferably, the single rigid panel member 31 at the first end 14*f* may be further reinforced with a secondary bar or support member 32 (e.g. within the front-end portion 14*f*). Advantageously, such a support member 32 can support the single rigid panel member 31 and will allow a user U to push the front end portion 14*f* with their head through snow, mud or the like, and still maintain said front-end portion 14*f* in a substantially upright manner (as it is supported by said support member) thereby maintaining the integrity of the liquid catching basin 20. Moreover, since the folding axis A is perpendicular to said front-end and rear-end portions 14*f*, 14*r*, these portions 14*f*, 14*r* (and any associated support member or bar) will not need to be folded on top of themselves. In the embodiment of FIGS. 1-5*f*, only the side walls 14*s*, 14*s*' are folded on top of themselves; see FIGS. 4*a*-5*f*.

The rigid panel members 30 are preferably provided in a serial (end-to-end), non-overlapping manner along each of the first and second side walls 14*s*, 14*s*' as shown in FIGS. 5*a*-5*d*. More preferably, the rigid panel members 30 along the first side wall 14*s* are provided at panel locations L that substantially mirror the placement and locations of corresponding panel members 30' positioned along the second side wall 14*s*', see FIG. 5*a*.

More preferably, at the interface (or meeting point) of adjacent panel member (e.g. 30*a*, 30*b* in FIG. 5*a*) a small portion of the flexible and foldable material M of the circumferential wall 14 is left unsupported by any rigid member 30 (e.g. ¼ inch width of foldable material M between adjacent sections) so as to define a folding section 34. When this is done, corresponding folding sections 34, 34' on each of the first and second side walls 14*s*, 14*s*' will substantially align and, given their flexible and foldable nature (and the flexible and foldable nature of the bottom 12), provide one or more fold axes F, F', F" that run therebetween and which are aligned substantially perpendicular to the folding axis A. The body 10*b* may be folded at one or more of the fold axes F, F', F", so that the creeper 10 can be folded from rear to front in a direction along folding axis A (or vice versa); see FIGS. 4*a* to 5*f*. Similarly, end-fold axes FE, FE' may be provided at each of the first and second ends (10*f*, 10*r*) and preferably also comprise a small portion of the flexible and foldable material M of the circumferential wall 14 which is unsupported by any rigid member 30. The first and second end wall portions 14*f*, 14*r* may be folded about their respective end-fold axes FE, FE' towards (or away from) the bottom 12.

Each of the first and second side walls 14*s*, 14*s*' are preferably provided with a flexible folding segment 40 at each end of said side walls 14*s*, 14*s*', i.e. where the side walls 14*s*, 14*s*' meet the front-end and rear-end portions 14*f*, 14*r* (see FIG. 3*c*, 3*d*, 4*a*, 5*a*). The flexible folding segment 40 is therefore a section of the side walls 14*s*, 14*s*' that is unsupported by a rigid panel member, and is able to fold on itself, thereby aiding the raising/lowering of the circumferential wall 14 relative to the bottom 12; see FIG. 4*a*.

Preferably, a pivotable, rigid and substantially planar locking member 50 is provided for supporting the one or more flexible folding segments 40 when the creeper 10 is in the unfolded configuration UC. In the embodiment of FIGS. 1-5*f*, two pivoting, locking members 50 are provided on the inside of the rear-end portion 14*r*, mounted at the interface or connection between the rear-end portion 14*r* and the side walls 14*s*, 14*s*'; see FIGS. 3*a*-3*d*.

Figure 3A:
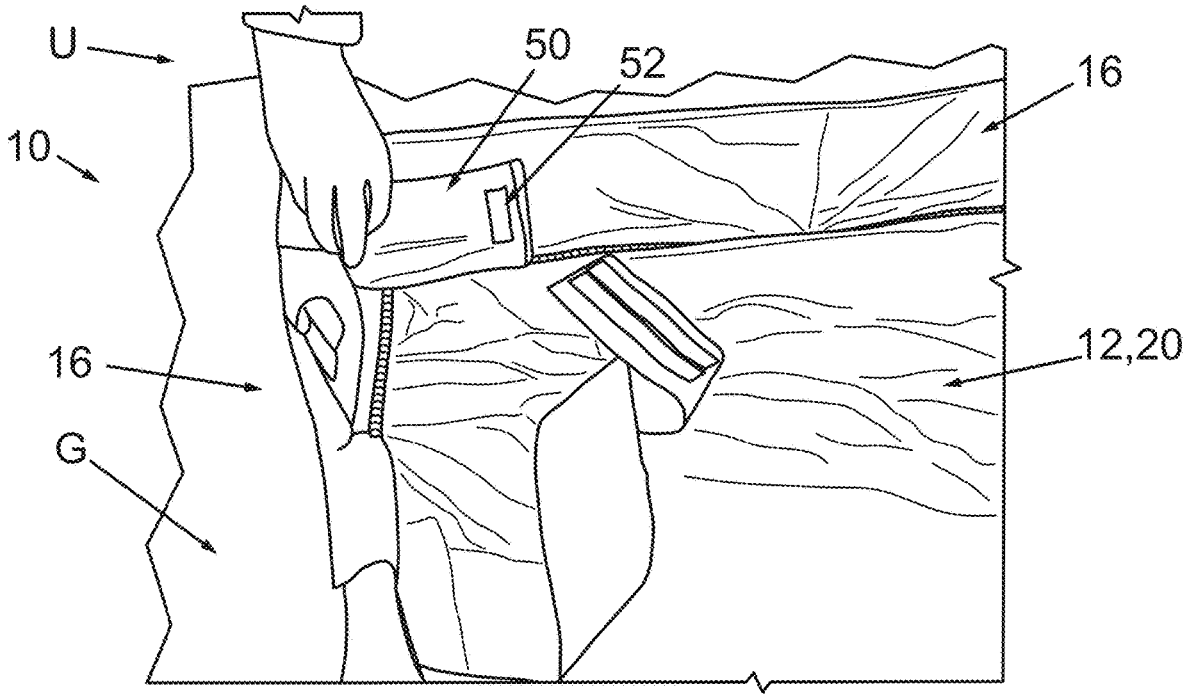
FIGS. 3*a* to 3*d* are perspective views of the foldable creeper of FIG. 1, showing a locking member next to a flexible folding segment.
Figure 3B:
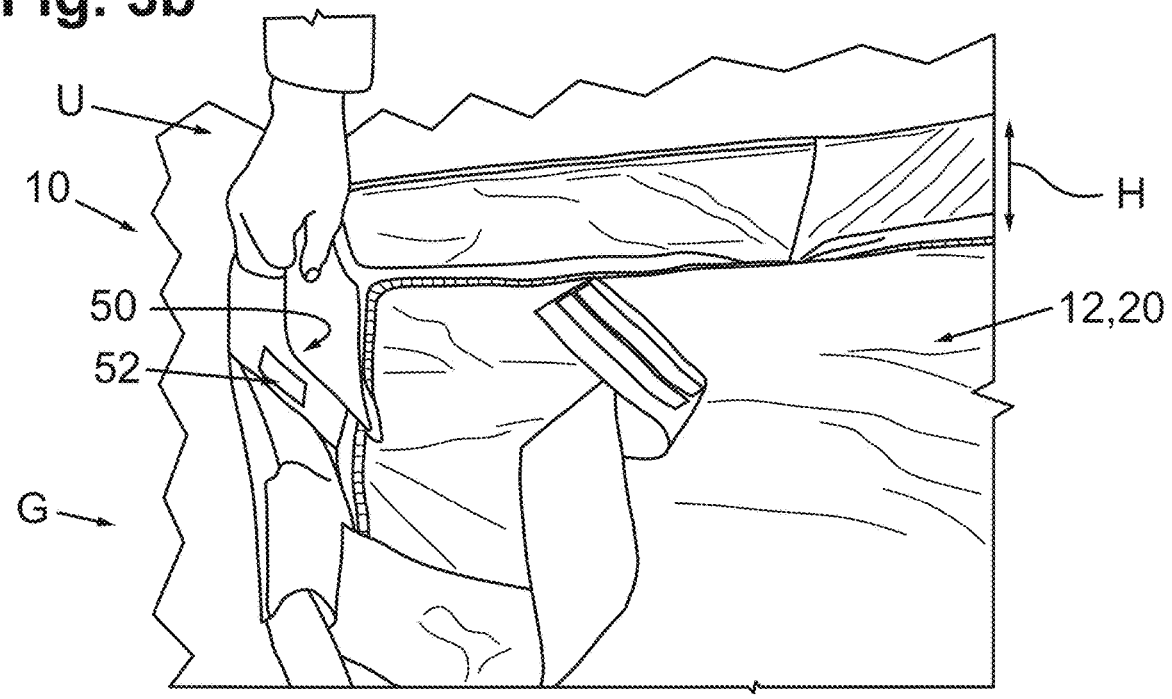
Figure 3C:
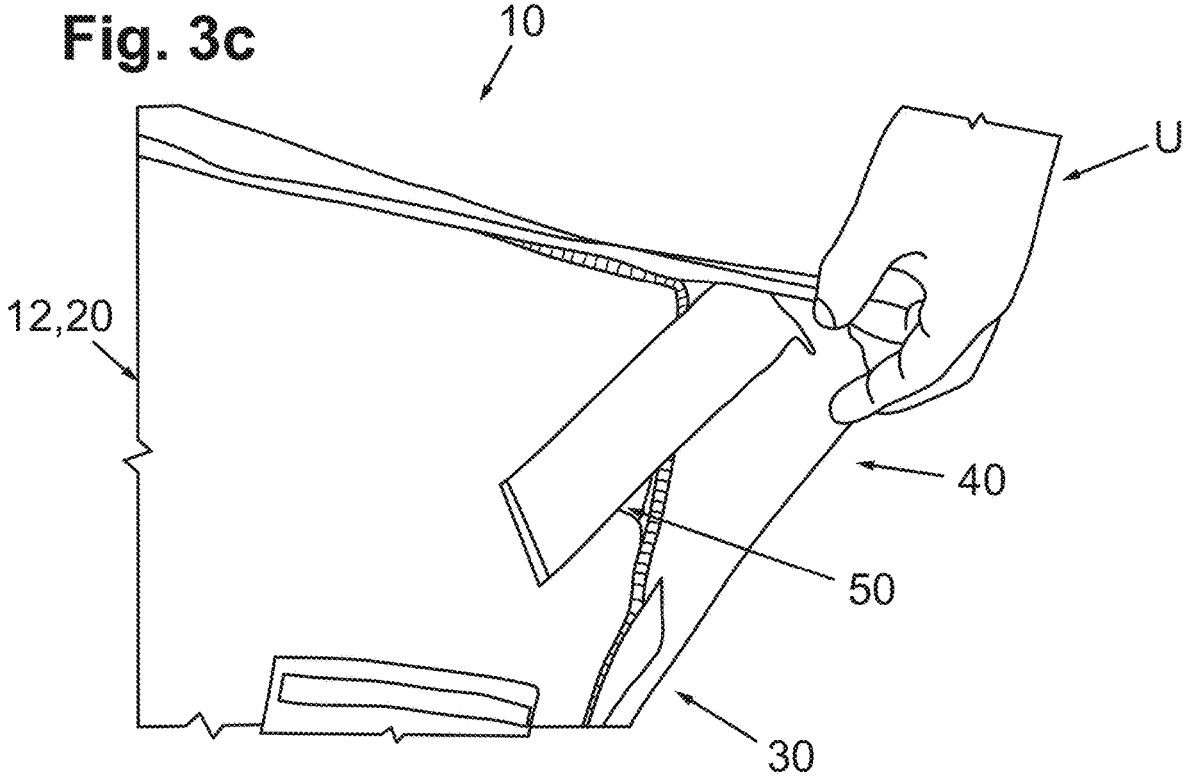
Figure 3D:
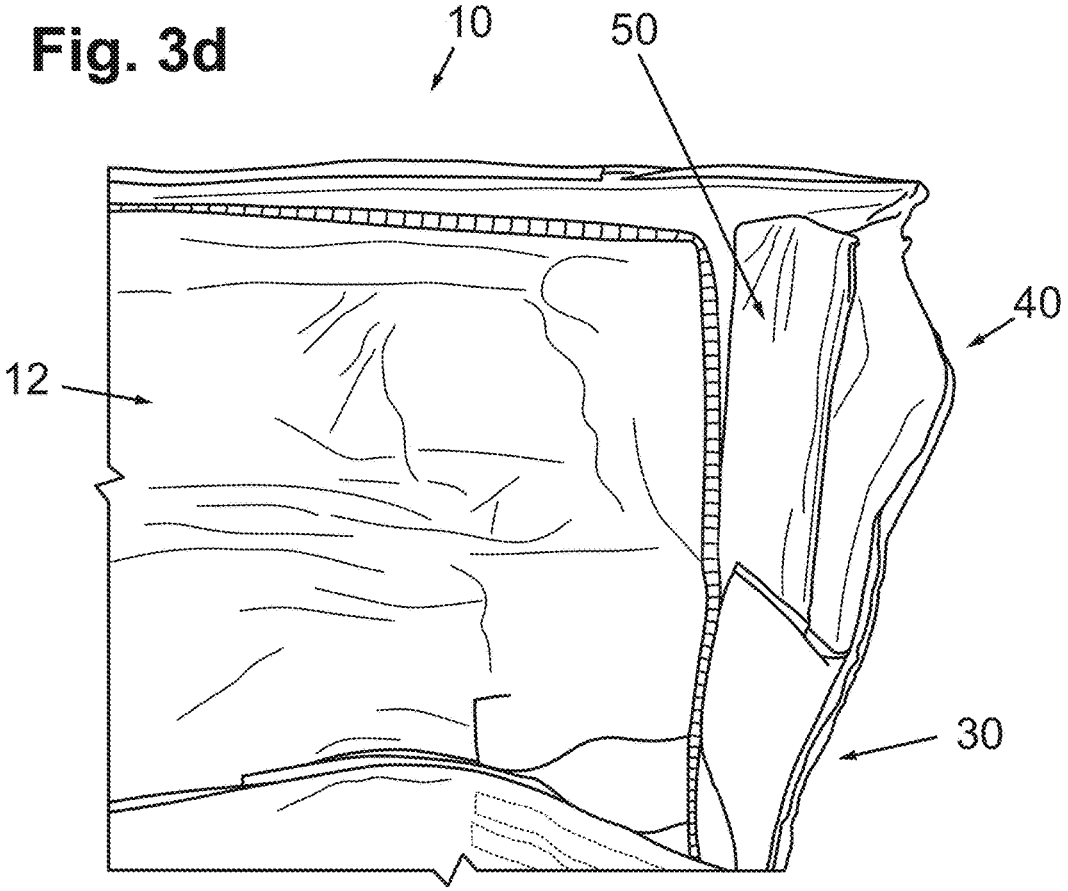

In this embodiment, the locking members 50 can pivot between a storage configuration (wherein they are substantially parallel to the rear-end portion 14*r* and do not interfere with the folding of the creeper 10 along the folding axis A, see FIG. 3*a*) and a supporting configuration (where they are substantially parallel to the folding segments 40 and supporting said segments 40 in a raised position when the creeper 10 is in the unfolded configuration, see FIG. 3*d*). A removable attachment 52 means, such as a VELCRO™ brand hook and loop fastener, may be provided to retain the locking members 50 in the supporting configuration.

Figure 4A:
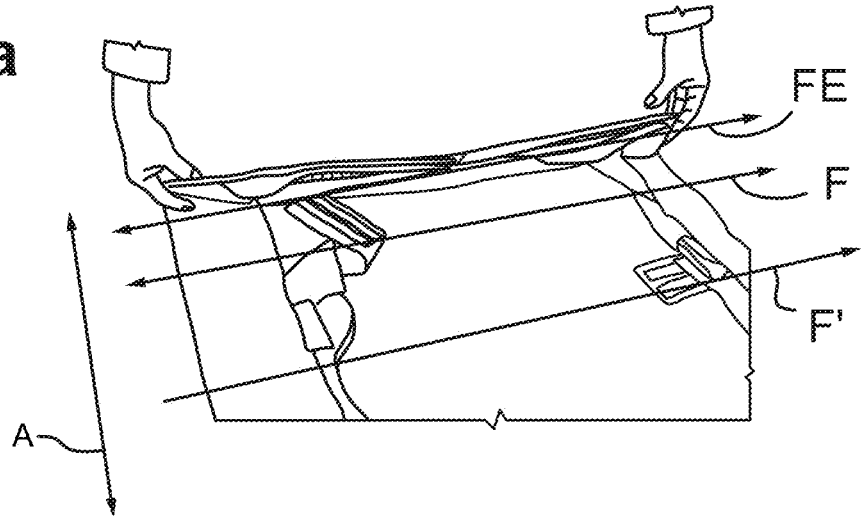
FIGS. 4*a* to 4*c* are perspective views of the foldable creeper of FIG. 1, showing it being folded into a folded configuration in an end-over-end manner.
Figure 4B:
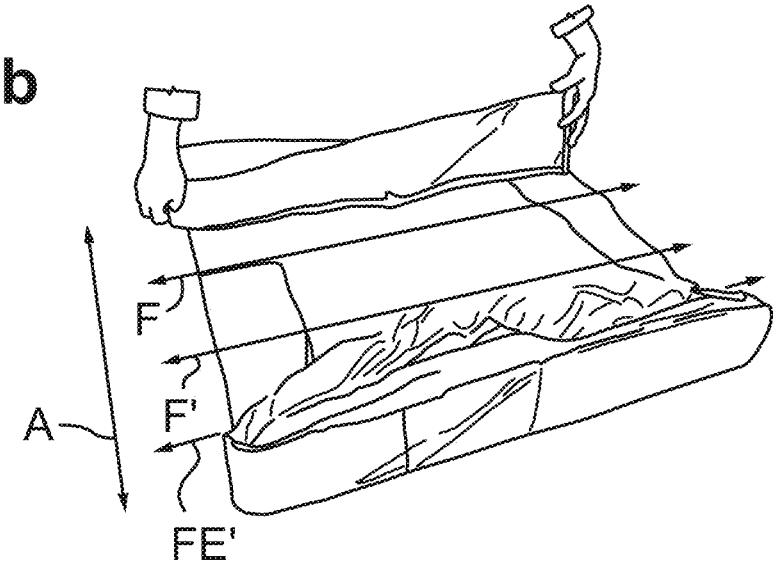
Figure 4C:
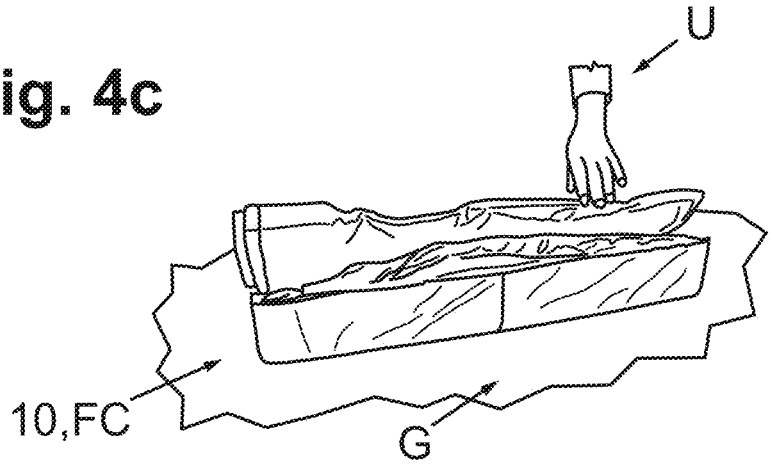
Figure 5A:
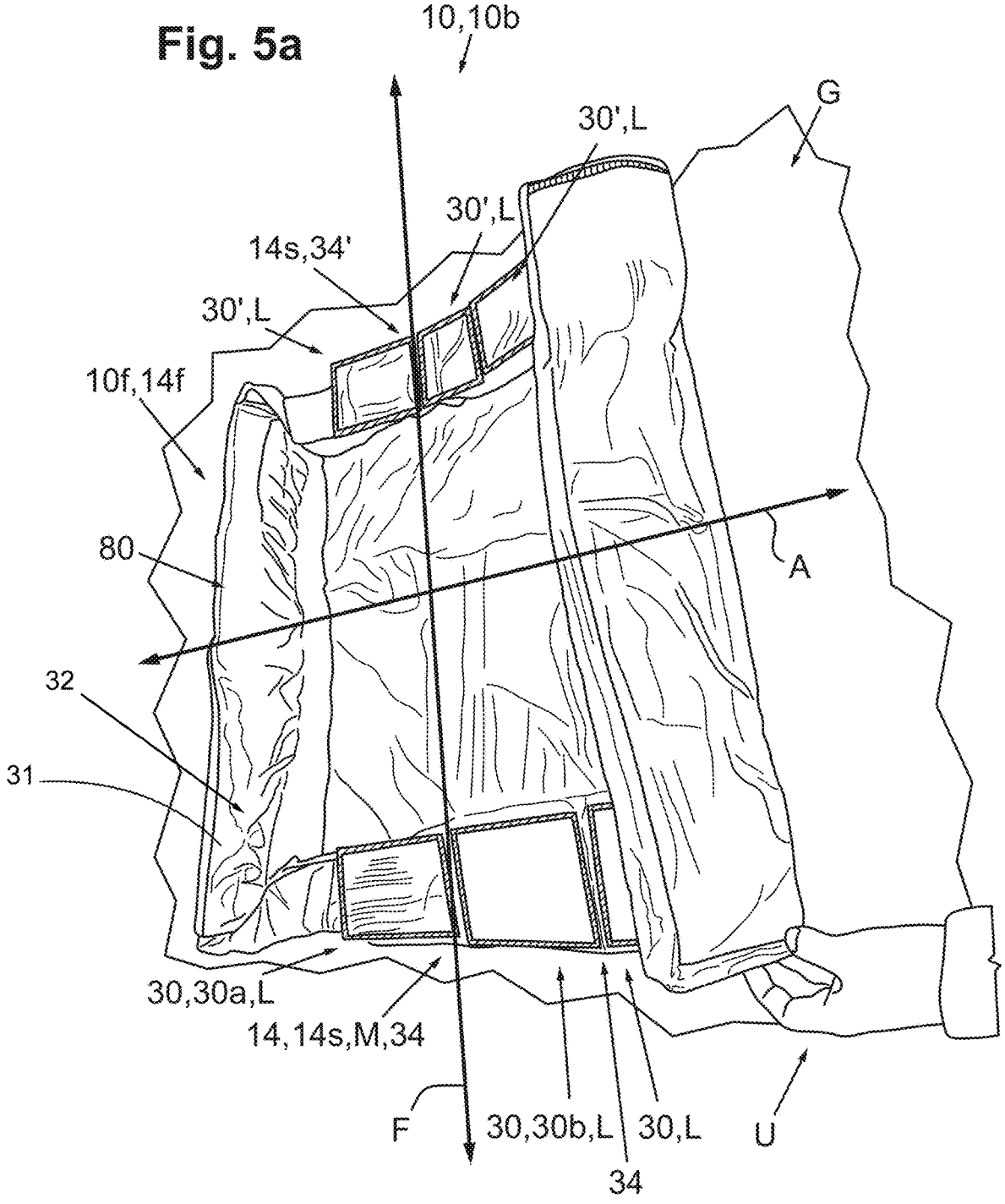
FIGS. 5*a* to 5*f* are additional perspective views of the foldable creeper of FIG. 1, showing it being folded into a folded configuration.
Figure 5B:
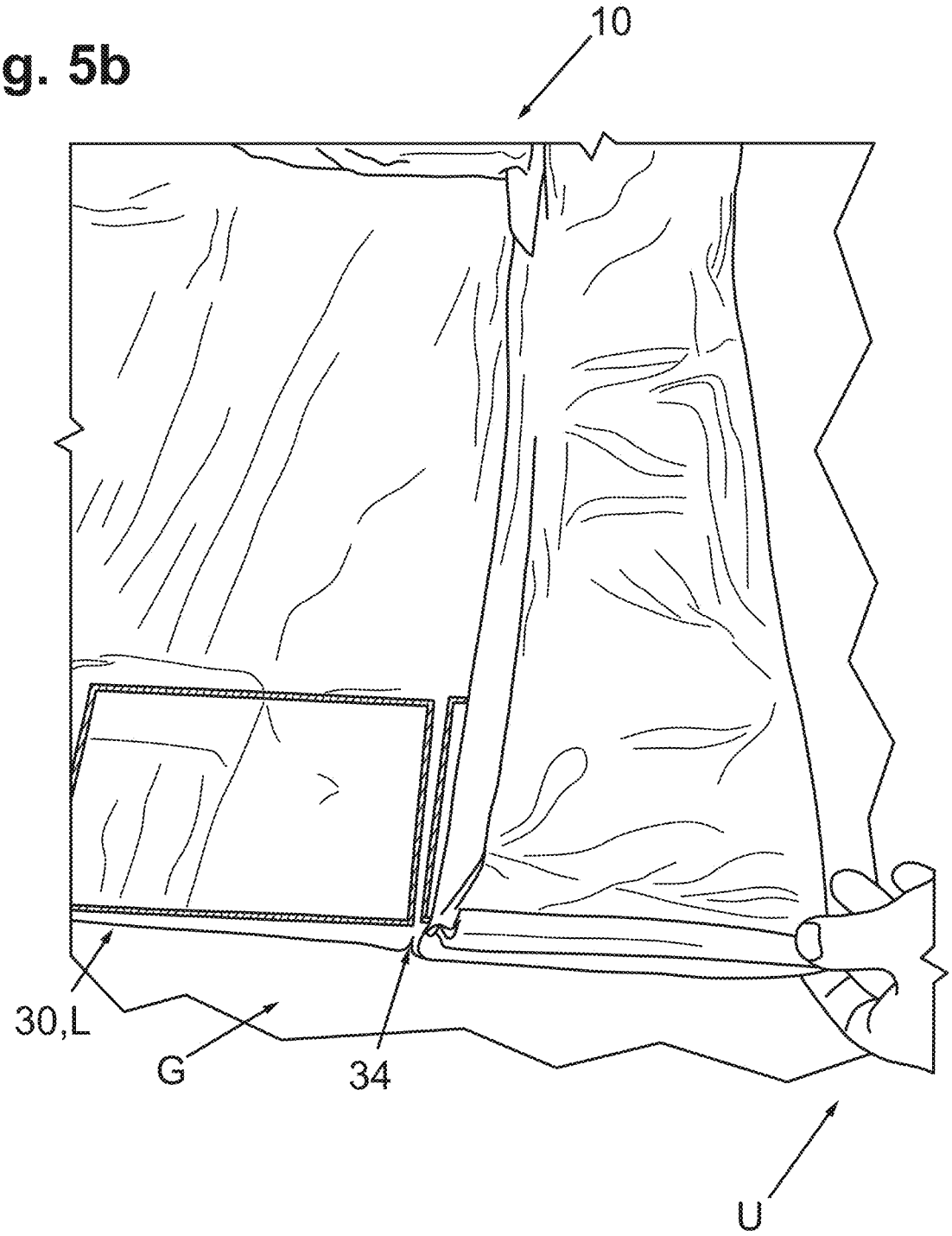
Figure 5C:
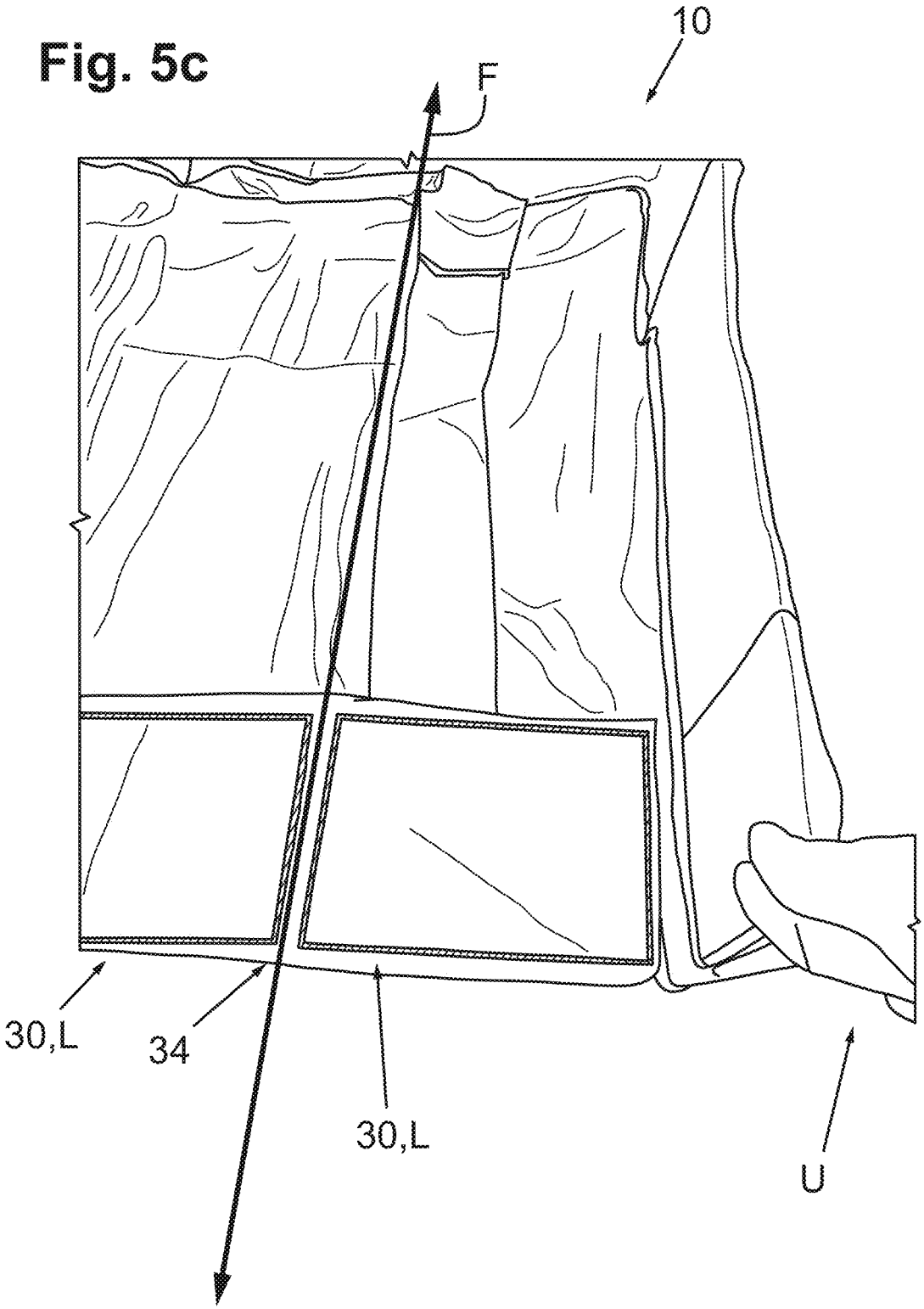
Figure 5D:
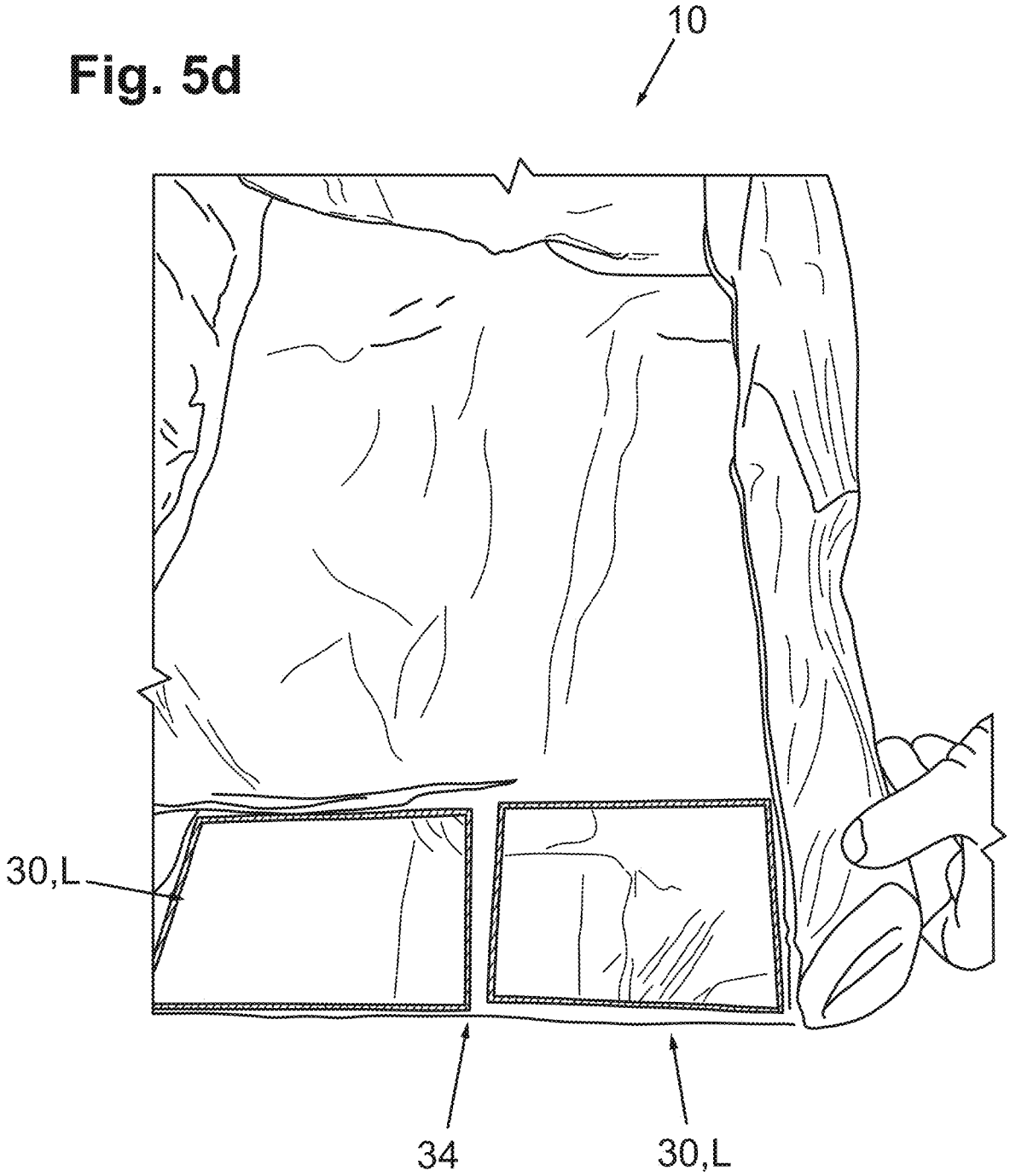
Figure 5E:
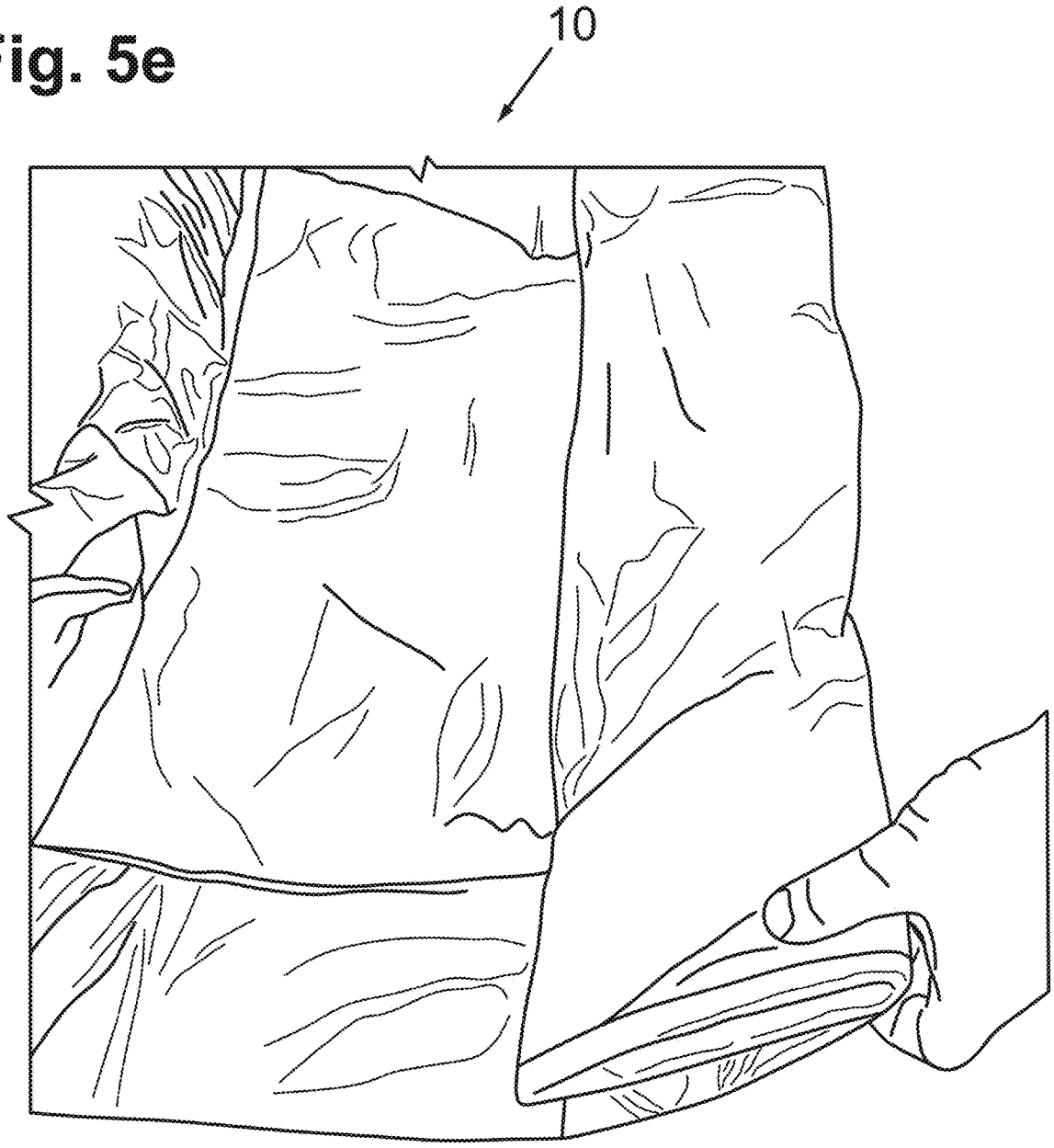
Figure 5F:
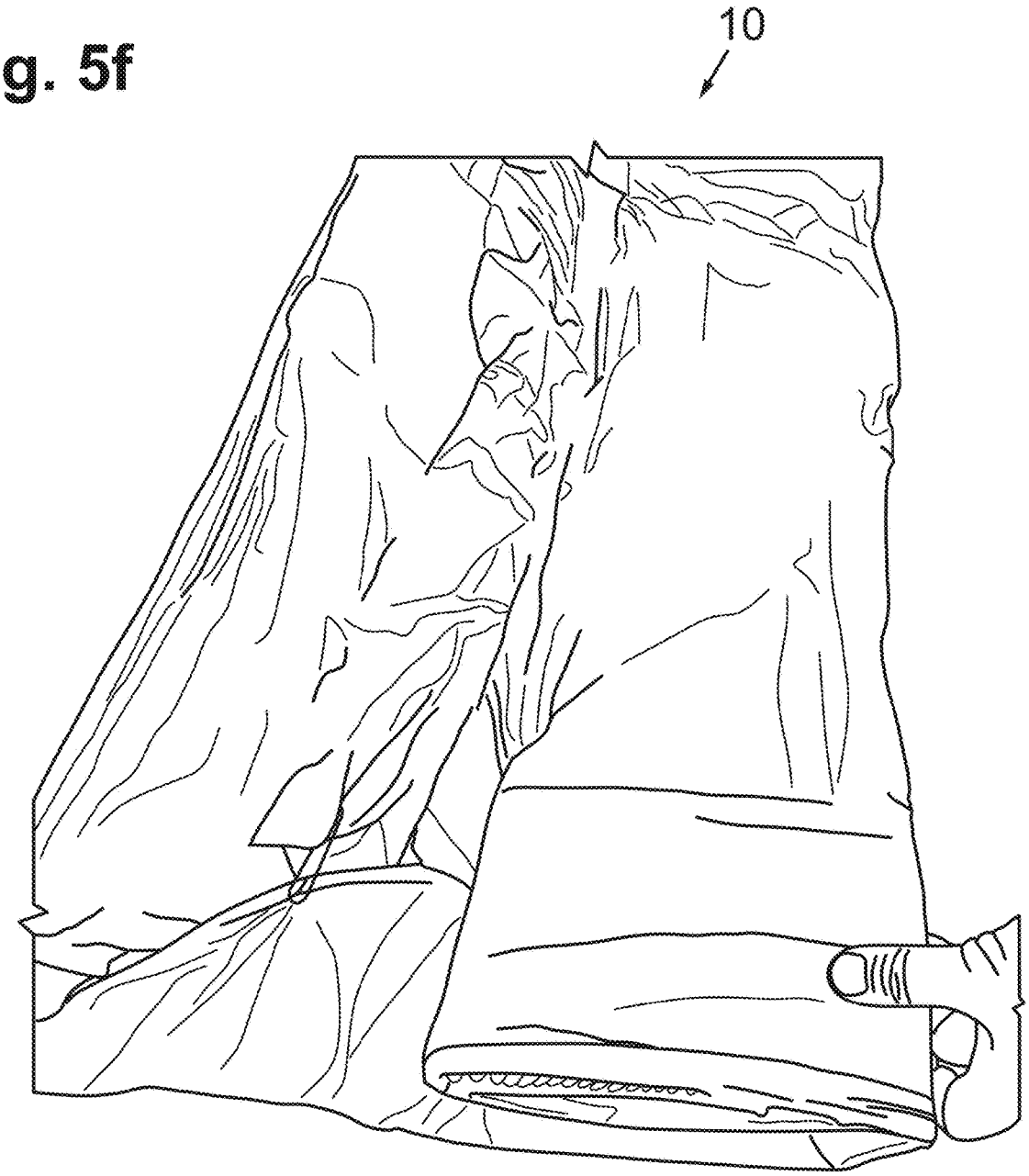
Figure 6A:
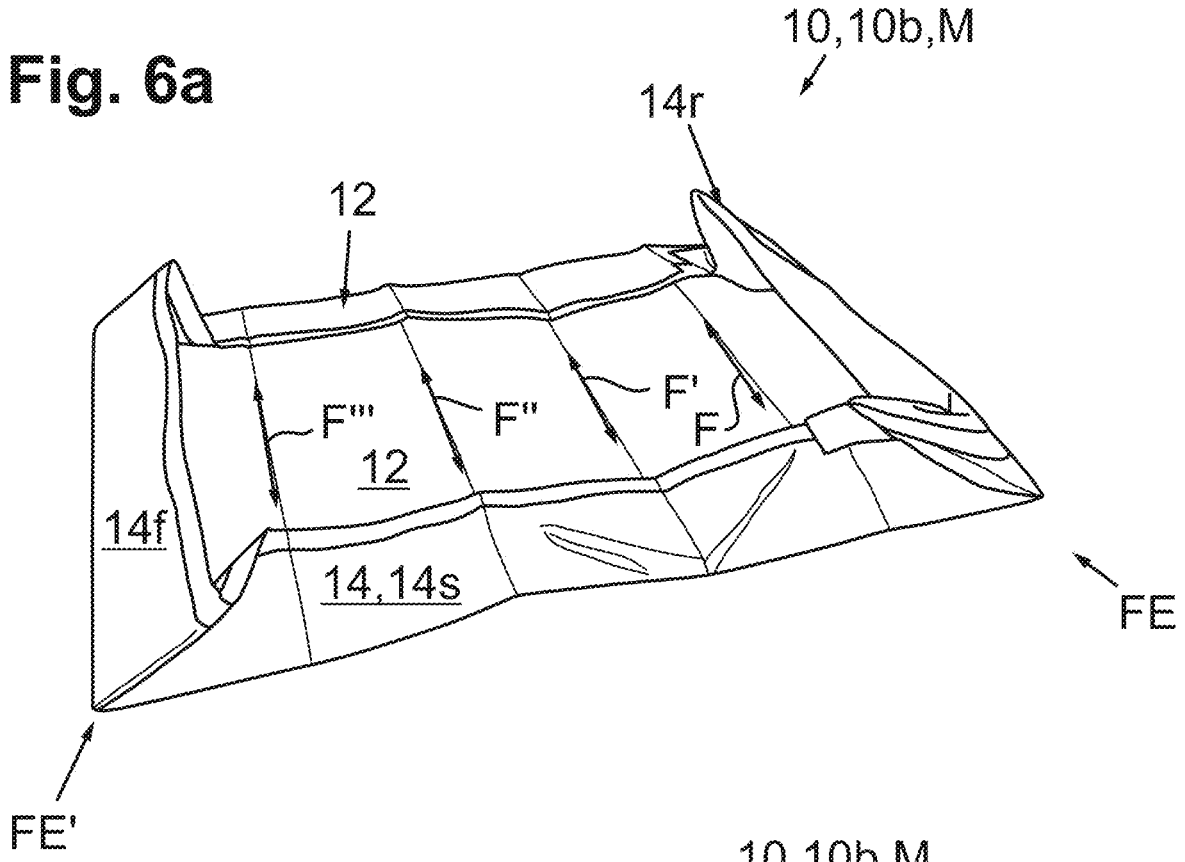
FIGS. 6*a* to 6*e* are perspective views of another embodiment of the foldable creeper, showing it being folded into a folded configuration in an accordion-like manner.
Figure 6B:
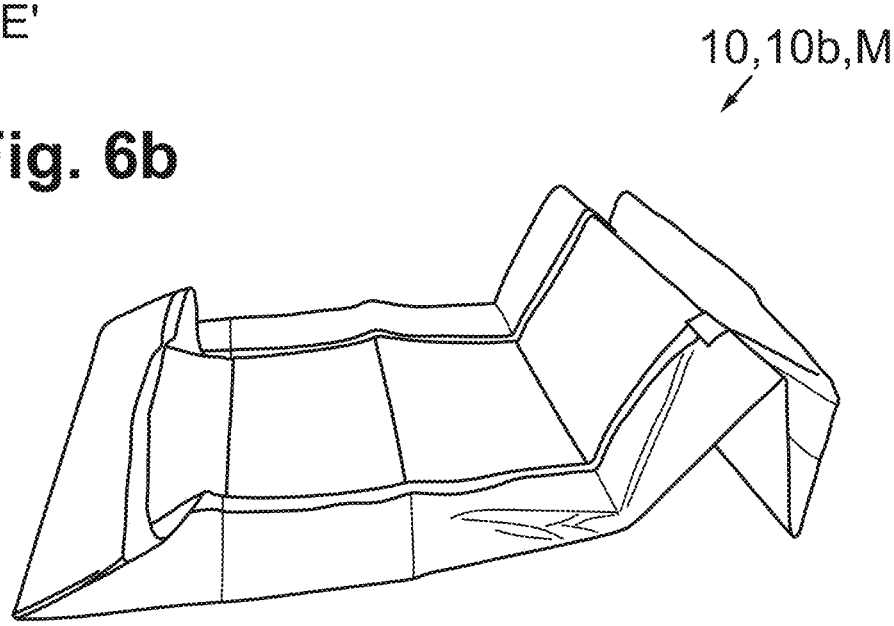
Figure 6C:
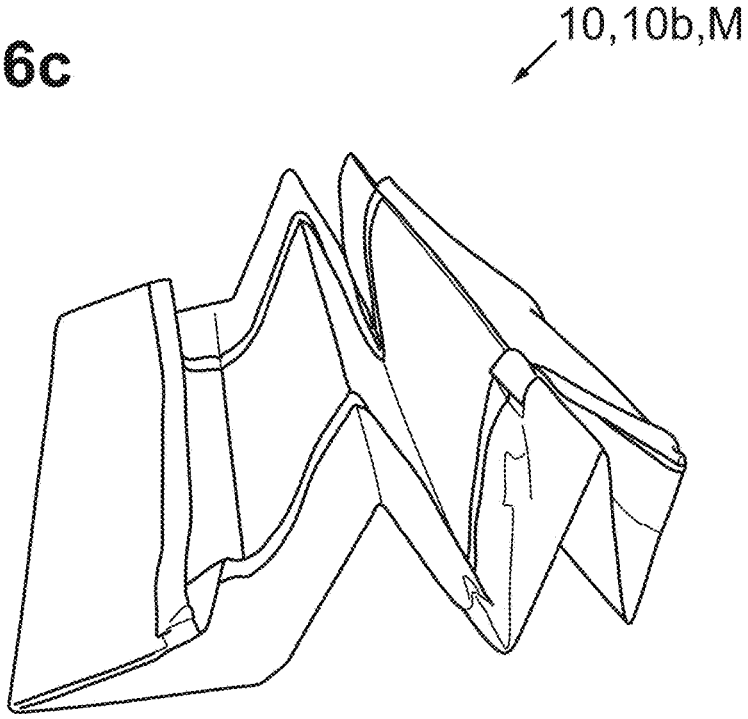
Figure 6D:
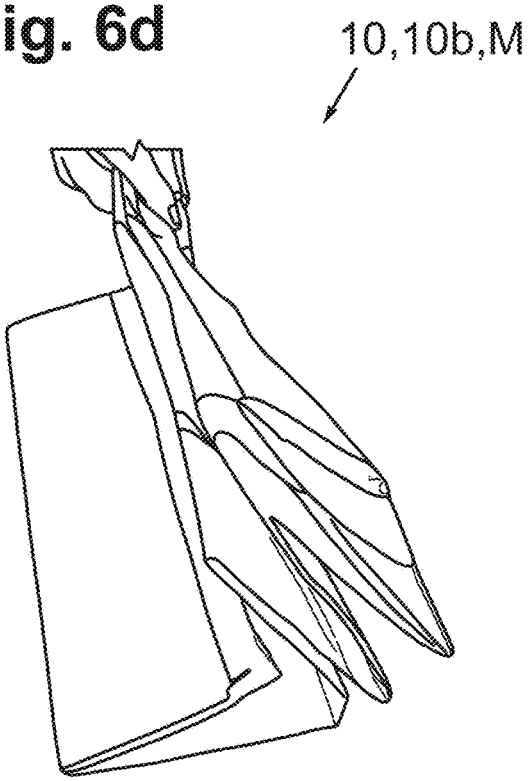
Figure 6E:
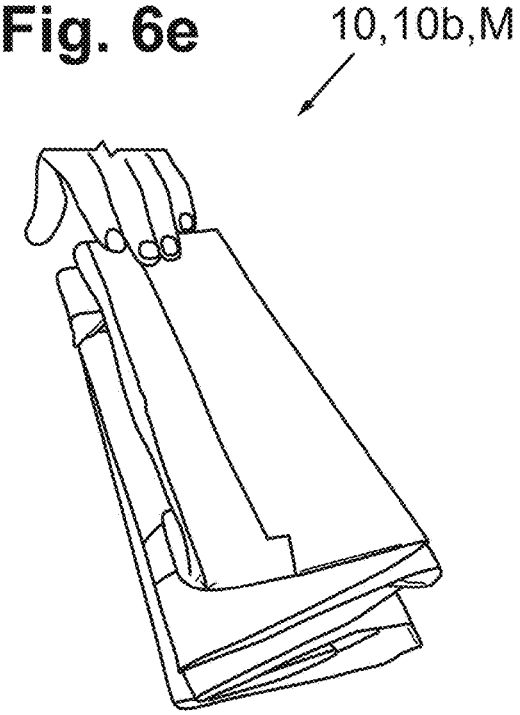

Folding and unfolding the creeper 10 between the unfolded configuration UC and folded configuration FC may be done in an end-over-end manner as shown in FIGS. 4*a* to 4*c*. Or the creeper may be folded and unfolded in an alternating manner, i.e. to create an accordion-like fold, as shown in FIGS. 6*a* to 6*e*. Advantageously, when folded and unfolded in the accordion-like manner illustrated in FIGS. 6*a* to 6*e*, the exterior surface of the bottom 12 does not touch the interior surface of the bottom 12 (as is the case when folding end-over-end). More advantageously, any snow or mud that might be attached to the exterior surface of the bottom 12 will not be introduced onto the interior surface of the bottom 12, allowing said interior surface to remain dry and uncontaminated by such snow or mud, and reducing the amount of cleaning of the creeper 10 for any subsequent use by a user U.

Preferably, the creeper 10 further comprises a light source 60 and associated power source (not shown), such as a flexible and foldable LED light strip 62 mounted around the periphery of the bottom 12 (see FIG. 2). Advantageously, the foldable LED light strip can be folded with the creeper 10 along the fold axis F. More advantageously, the light source 60 will assist a user U working underneath a vehicle or the like by illuminating the working area.

More preferably, the creeper 10 further comprises a strap 70 to fasten a user U to the creeper 10 when in use. The strap 70 is preferably provided with a removable attachment means 72, such as a VELCRO™ brand hook and loop fastener to fully, or partially, remove the strap 70 from the creeper 10 and/or adjust the strap's length to accommodate different sized users.

Even more preferably, the front-end portion 14*f* further comprises a cushioned or padded head rest 80 and head strap to support, and strap to, a user's head while using the creeper 10. The head rest 80 is preferably supported by the support bar 32. Additionally, the light source's power source may comprise a small battery and associated circuitry that is mounted within or adjacent the head rest 80, or on the support bar 32. Still even more preferably, the bottom 12 is of sufficient dimensions and surface area (when in the unfolded configuration) to allow a user's head, torso and hips to be supported thereupon, while also allowing a user's legs to extend or drape over the rear-end 10*r*; see FIG. 2. Advantageously, a user U can strap themselves into the creeper 10 using the strap 70 and any head strap, extend their legs over the rear-end 10*r*, and push against the ground G with their legs and exert a force against the front-end 10*f* to move or advance the creeper 10 forward across the ground G. Advantageously, the side walls 14*s* and basin 20 will function not only to contain any oil, water or other liquid that may come off of a vehicle, but will also push any snow or mud that may be on the ground G away from the creeper's interior, thereby keeping a user U dry and clean.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. A foldable creeper (10) comprising:

a foldable body (10*b*) comprised of a foldable material (M), having a first end (10*f*), a second end (10*r*) and foldable in a direction along a folding axis A;

a bottom (12);

a raisable circumferential wall (14) having first end portion (14*f*), a second end portion (14*r*), a first side wall 14*s* and a second side wall 14*s*', said first and second side walls (14*s*, 14*s*') running along axes that are substantially parallel to the folding axis (A); and a plurality of rigid panel members (30) positioned at panel locations (L) within or along each of the first and second side walls (14*s*, 14*s*');

wherein the first end portion (14*f*), the second end portion (14*r*) and the first and second side walls (14*s*, 14*s*') are moveable relative to the bottom (12) and cooperate to form a circumferential raised barrier (16) around the periphery of said bottom 12 when the creeper (10) is in an unfolded configuration;

wherein each of the first and second side walls (14*s*, 14*s*') further comprise a flexible folding segment (40) at each end of said side walls (14*s*, 14*s*');

wherein the foldable creeper (10) further comprises one or more locking members (50) for supporting the flexible folding segments (40);

wherein the one or more locking members (50) are pivotable between a storage configuration and a supporting configuration;

wherein the one or more locking members (50) are provided on the inside of the second-end portion 14*r*, mounted at the interface between the second-end portion (14*r*) and one of the side walls (14*s*, 14*s*'); and wherein, when the one or more locking members (50) are in the storage configuration, said one or more locking members (50) are substantially parallel to the rear-end portion (14*r*) and do not interfere with the folding of the creeper (10) along the folding axis (A).

2. The foldable creeper (10) of claim 1 wherein the foldable material (M) is capable of containing water, oil and other liquids that may drain or leak out of a motor vehicle and wherein when in the unfolded configuration and used underneath the motor vehicle, the bottom (12) and the circumferential raised barrier (16) cooperate to create a liquid catching basin (20); and wherein the one or more locking members (50) are positioned and pivotable between the storage configuration and the supporting configuration within the liquid catch basis (20).

3. The foldable creeper (10) of claim 1 wherein the plurality of rigid panel members (30) maintain the foldable material (M) of the circumferential wall (14) in a raised and upright position when the creeper (10) is in the unfolded configuration.

4. The foldable creeper (10) of claim 3 wherein the rigid panel members (30) are provided in a serial, non-overlapping manner at their respective panel locations (L).

5. The foldable creeper (10) of claim 4 wherein the rigid panel members (30) along the first side wall (14*s*) are provided at panel locations L that substantially mirror the placement and locations of corresponding panel members (30') positioned along the second side wall (14*s*').

6. The foldable creeper (10) of claim 5 wherein, at each interface of adjacent panel members, a small portion of the foldable material (M) is left unsupported by any rigid panel member (30) and defines a folding section (34).

7. The foldable creeper (10) of claim 6 wherein corresponding folding sections (34) on each of the first and second side walls (14*s*, 14*s*') substantially align with each other and define one or more fold axes therebetween.

8. The foldable creeper (10) of claim 7 wherein the one or more fold axes are aligned substantially perpendicular to the folding axis (A).

9. The foldable creeper (10) of claim 1 wherein the circumferential wall (14) further comprises a plurality of pockets at the panel locations (L) and wherein said plurality of pockets are sized to receive the plurality of rigid panel members (30) therein.

10. The foldable creeper (10) of claim 1 wherein the plurality of rigid members (30) are comprised of cardboard, plastic or wood.

11. The foldable creeper (10) of claim 1 wherein the plurality of rigid panel members (30) are attached to the side walls (14*s*) at their respective panel locations (L).

12. The foldable creeper (10) of claim 1 further comprising a light source (60).

13. The foldable creeper (10) of claim 12 wherein the light source (60) is a foldable light strip (62) mounted around the periphery of the bottom (12).

14. The foldable creeper (10) of claim 1 further comprising a strap (70) having a removable attachment means (72) to remove the strap (70) from the creeper (10) or adjust the strap's length to accommodate different sized users.

15. The foldable creeper (10) of claim 1 wherein a single rigid panel member (31) is provided at the first end portion (14*f*).

16. The foldable creeper (10) of claim 15 wherein the single rigid panel member (31) is provided within the first end portion (14*f*), said single rigid panel member (31) being reinforced with a support member (32) within the first end portion (14*f*).

17. The foldable creeper (10) of claim 1 wherein a head rest (80) is provided at the first end portion (14*f*).

18. The foldable creeper (10) of claim 17 wherein the head rest (80) is supported by a support member (32) within the first end portion (14*f*).

19. A foldable creeper (10) comprising:

a foldable body (10*b*) comprised of a foldable material (M), having a first end (10*f*), a second end (10*r*) and foldable in a direction along a folding axis A;

a bottom (12);

a raisable circumferential wall (14) having first end portion (14*f*), a second end portion (14*r*), a first side wall 14*s* and a second side wall 14*s*', said first and second side walls (14*s*, 14*s*') running along axes that are substantially parallel to the folding axis (A); and a plurality of rigid panel members (30) positioned at panel locations (L) within or along each of the first and second side walls (14*s*, 14*s*');

wherein the first end portion (14*f*), the second end portion (14*r*) and the first and second side walls (14*s*, 14*s*') are moveable relative to the bottom (12) and cooperate to form a circumferential raised barrier (16) around the periphery of said bottom 12 when the creeper (10) is in an unfolded configuration; and further comprising a head rest (80) at the first end portion (14*f*).

* * * * *